US006660461B2

(12) United States Patent
Haye et al.

(10) Patent No.: US 6,660,461 B2
(45) Date of Patent: Dec. 9, 2003

(54) STABILIZED AMPLIFIED COLOR DEVELOPING COMPOSITION, MULTI-PART KITS, AND METHOD OF USE

(75) Inventors: Shirleyanne E. Haye, Rochester, NY (US); Janet M. Huston, Webster, NY (US); Richard R. Horn, Fairport, NY (US); Anthony Jarkowski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/285,906

(22) Filed: Nov. 1, 2002

(65) Prior Publication Data

US 2003/0134235 A1 Jul. 17, 2003

Related U.S. Application Data

(63) Continuation-in-part of application No. 09/804,339, filed on Mar. 12, 2001, now Pat. No. 6,503,696, which is a continuation-in-part of application No. 09/438,121, filed on Nov. 10, 1999, now Pat. No. 6,416,940.

(51) Int. Cl.[7] ..... G03C 7/413

(52) U.S. Cl. ..... 430/373; 430/372; 430/414; 430/429

(58) Field of Search ..... 430/373, 372, 430/414, 429

(56) References Cited

U.S. PATENT DOCUMENTS

| | | | | |
|---|---|---|---|---|
| 4,414,305 A | * 11/1983 | Nakamura et al. | ..... | 430/373 |
| 4,546,068 A | 10/1985 | Kuse | ..... | 430/375 |
| 4,596,765 A | 6/1986 | Kurematsu et al. | ..... | 430/467 |
| 4,873,180 A | 10/1989 | Marchesano et al. | ..... | 430/491 |
| 4,876,174 A | 10/1989 | Ishikawa et al. | ..... | 430/380 |
| 4,892,804 A | 1/1990 | Vincent et al. | ..... | 430/380 |
| 4,900,651 A | 2/1990 | Ishikawa et al. | ..... | 430/380 |
| 4,975,357 A | 12/1990 | Buongiorne et al. | ..... | 430/433 |
| 5,034,308 A | 7/1991 | Abe et al. | ..... | 430/372 |
| 5,273,865 A | 12/1993 | Loiacono et al. | ..... | 430/490 |
| 5,354,646 A | 10/1994 | Kobayashi et al. | ..... | 430/372 |
| 5,660,974 A | 8/1997 | Marrese et al. | ..... | 430/490 |
| 5,702,873 A | 12/1997 | Twist | ..... | 430/373 |
| 5,723,268 A | 3/1998 | Fyson | ..... | 430/430 |
| 6,136,518 A | 10/2000 | Buongiorne et al. | ..... | 430/486 |
| 6,159,670 A | 12/2000 | Buongiorne et al. | ..... | 430/491 |
| 6,312,877 B1 | 11/2001 | Buongiorne et al. | ..... | 430/450 |
| 6,403,290 B1 | 6/2002 | Haye et al. | ..... | 430/357 |
| 6,416,940 B2 | 7/2002 | Haye et al. | ..... | 430/466 |

FOREIGN PATENT DOCUMENTS

| | | |
|---|---|---|
| EP | 0 204 372 | 10/1986 |
| EP | 0 793 141 A2 | 9/1997 |
| EP | 0 800 111 A1 | 10/1997 |

OTHER PUBLICATIONS

*Research Disclosure*, publication 13410, Jun., 1975.
*Research Disclosure*, publication 20405, Apr., 1981.
*Research Disclosure*, publication 18837, Dec., 1979.

* cited by examiner

*Primary Examiner*—Hoa Van Le
(74) *Attorney, Agent, or Firm*—J. Lanny Tucker

(57) ABSTRACT

An amplified color developing composition is stabilized with a cyclicaminomethanediphosphonic acid or salt thereof alone of in combination with other stabilizing compounds. This composition also comprises a color developing agent, a redox oxidizing agent (such as hydrogen peroxide), and a hydroxylamine antioxidant for the color developing agent. The amplified color developing composition can be formulated using a two- or three-part processing kit. The composition can be used to provide images in various color photographic silver halide materials such as color photographic papers.

20 Claims, No Drawings

STABILIZED AMPLIFIED COLOR DEVELOPING COMPOSITION, MULTI-PART KITS, AND METHOD OF USE

COPENDING APPLICATION

The present application is a Continuation-in-part of U.S. Ser. No. 09/804,339 filed Mar. 12, 2001 now U.S. Pat. No. 6,503,696 that is a Continuation-in-part of U.S. Ser. No. 09/438,121, filed Nov. 10, 1999 by Haye et al that was granted as U.S. Pat. No. 6,416,940.

FIELD OF THE INVENTION

The present invention relates to stabilized photographic amplified color developing compositions, sometimes known as "redox" amplification compositions, and to a method for their use. This invention also relates to two- and three-part kits that provide these compositions. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have been used with considerable commercial success in the photographic industry. Other known color developing compositions are described in U.S. Pat. No. 4,876,174 (Ishikawa et al.), U.S. Pat. No. 5,354,646 (Kobayashi et al.) and U.S. Pat. No. 5,660,974 (Marrese et al.).

Color development is generally followed with one or more desilvering steps, such as bleaching and fixing steps, or a combined bleach-fixing step. In such processes, color development can continue until the photographic material enters the bleaching or bleach-fixing solution.

Calcium or other metal ions in photographic processing compositions (such as color developing compositions) have been sequestered or complexed using a wide variety of organic complexing agents including various polyaminocarboxylic acids and polyphosphonic acids. Such innovations are described for example in U.S. Pat. No. 4,873,180 (Marchesano et al.), U.S. Pat. No. 6,416,940 (Haye et al.), and U.S. Pat. No. 6,159,670 (Buongiorne et al.).

In redox amplification (or RX) processes, imagewise exposed color photographic materials are developed to provide a silver image and then treated with a redox amplification composition (or a combined developer-amplifier composition) to form a dye image. Desilvering can then follow these steps. Such processes are well known in the art and described for example in U.S. Pat. No. 5,702,873 (Twist) and U.S. Pat. No. 5,723,268 (Fyson) and references cited therein.

A redox amplification composition (or as identified below as an amplified color developing composition) contains a reducing agent (usually a color developing agent) and a redox oxidizing agent (usually hydrogen peroxide) that is more powerful than silver halide and that will oxidize the reducing agent in the presence of the silver image that acts as a catalyst. The oxidized reducing agent (for example, the oxidized color developing agent) reacts with color forming couplers in the photographic material to form image dye. The redox amplification processes are particularly useful for processing color photographic papers that comprise relatively low amounts of silver chloride.

Since the amplified color developing compositions contain both an oxidizing agent and a reducing agent, they are inherently unstable and will decompose upon keeping. This instability is catalyzed during processing by various species in the processing environment that come from various sources.

U.S. Pat. 5,702,873 (noted above) describes the use of various metal ion sequestering agents such as polyaminocarboxylic, polyphosphonic or poly sulfonic acids that provide improved stability for various amplified color developing compositions.

Despite the continuing research by the industry to find ways to stabilize amplified color developing compositions, the industry has failed to provide sufficient stability so that such compositions could have general acceptance and use in commercial applications. Thus, there remains a need for means to increase the solution stability of redox amplification compositions. It is to this problem that the present invention is directed.

SUMMARY OF THE INVENTION

This invention provides an advance in the art with a stabilized photographic amplified color developing composition that comprises:

a) at least 0.001 mol/l of a color developing agent, b) at least 0.005 mol/l of a redox oxidizing agent, c) at least 0.001 mol/l of a hydroxylamine antioxidant, and d) at least 0.0005 mol/l of a cyclicaminomethanediphosphonic acid or a salt thereof.

In preferred embodiments, the present provides an aqueous redox amplification composition having a pH of from about 10 to about 12 and comprising:

a) from about 0.001 to about 1 mol/l of a color developing agent that is 4-(N-ethyl-N-β-hydroxyethylamino)-2-methylaniline sulfate (KODAK Color Developing Agent CD-4) or 4-(N-ethyl-N-2-methanesulfonylaminoethyl)-2-methylphenylenediamine sesquisulfate (KODAK Color Developing Agent CD-3), b) from about 0.001 to about 1 mol/l of hydroxylamine sulfate as an antioxidant for the color developing agent, c) from about 0.005 to about 5 mol/l of hydrogen peroxide or a compound that provides hydrogen peroxide, and d) from about 0.0005 to about 0.5 mol/l of morpholinomethanediphosphonic acid or a salt thereof.

This invention also provides a method for providing a color image comprising contacting an imagewise exposed color photographic element with a stabilized amplified color developing composition that comprises:

a) at least 0.001 mol/l of a color developing agent, b) at least 0.005 mol/l of a redox oxidizing agent, c) at least 0.001 mol/l of a hydroxylamine antioxidant, and d) at least 0.0005 mol/l of a cyclicaminomethanediphosphonic acid or a salt thereof.

In preferred embodiments, it provides a method for providing a color image comprising contacting an imagewise exposed color photographic element with a stabilized photographic redox amplification composition that has a pH of from about 10 to about 12 and comprises:

a) from about 0.001 to about 1 mol/l of a color developing agent that is 4-(N-ethyl-N-β-hydroxyethylamino)-2-methylaniline sulfate (KODAK Color Developing Agent CD-4) or 4-(N-ethyl-N-2-methanesulfonylaminoethyl)-2-methylphenylenediamine sesquisulfate (KODAK Color Developing Agent CD-3), b) from about 0.001 to about 1 mol/l of hydroxylamine sulfate as an antioxidant for the color developing agent, c) from about 0.005 to about 5 mol/l of hydrogen peroxide or a compound that provides hydrogen peroxide, and d) from about 0.0005 to about 0.5 mol/l of morpholinomethanediphosphonic acid or a salt thereof.

Still again, the present invention provides a method of photographic processing comprising the steps of:

A) contacting an imagewise exposed color photographic silver halide element with a stabilized amplified color developing composition that comprises:

a) at least 0.001 mol/l of a color developing agent, b) at least 0.005 mol/l of a redox oxidizing agent, c) at least 0.001 mol/l of a hydroxylamine antioxidant, and d) at least 0.0005 mol/l of a cyclicaminomethanediphosphonic acid or a salt thereof, and B) desilvering the color developed color photographic silver halide element.

A photographic processing kit of this invention comprises:

A) a first solution comprising a color developing agent, a cyclicaminomethanediphosphonic acid or salt thereof, and a hydroxylamine antioxidant, and B) a second solution that comprises a redox oxidizing agent.

In other embodiments, a photographic processing kit comprises:

A) a first solution that comprises a color developing agent,

B) a second solution that comprises a cyclicaminomethanediphosphonic acid or salt thereof, and C) a third solution that comprises a redox oxidizing agent, the first or second solution, or both, further comprising a hydroxylamine antioxidant.

The redox amplification composition of this invention offers a number of advantages over those currently known in the art. It is stabilized against loss in color developing agent activity, loss in antioxidant, and pH decrease with the use of a cyclicaminomethanediphosphonic acid (or salt thereof). In some embodiments, this stabilizing compound can be used in combination with one or more other polycarboxylic acids or polyphosphonic acids that are known in the art as metal ion sequestering agents.

DETAILED DESCRIPTION OF THE INVENTION

The composition of this invention is generally formulated in aqueous form and can be in concentrated or diluted form.

The amplified color developing composition of this invention contains one or more reducing agents that are color developing agents generally in the form of a sulfate salt as a first essential component. More specifically, the useful color developing agents are well known in the art as those compounds that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It maybe useful for the color developing agents to have one or more water-solubilizing groups as are known in the art. Further details of such materials are provided in Research Disclosure, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. The most preferred color developing agent is KODAK Color Developing Agent CD-3 especially for photoprocessing of photographic color papers.

In order to protect the color developing agents from oxidation, one or more antioxidants are generally included in the amplified color developing compositions as a second essential component. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Mixtures of compounds from the same or different classes of antioxidants can also be used if desired.

Especially useful antioxidants are hydroxylamine (such as hydroxylamine sulfate) and hydroxylamine derivatives as described for example, in U.S. Pat. No. 4,892,804 (Vincent et al.), U.S. Pat. No. 4,876,174 (Ishikawa et al.), U.S. Pat. No. 5,354,646 (Kobayashi et al.), U.S. Pat. No. 5,660,974 (Marrese et al.), and U.S. Pat. No. 5,646,327 (Bums et al.), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. Hydroxylamine sulfate is a most preferred antioxidant.

Many of the noted antioxidants (organic or inorganic) are either commercially available or prepared using starting materials and procedures described in the references noted above in describing hydroxylamines.

As a third essential component, the amplified color developing compositions of this invention also include one or more redox oxidizing agents (also known as a redox oxidant) that include peroxy compounds such as hydrogen peroxide and compounds that provide hydrogen peroxide (for example addition compounds of hydrogen peroxide), sodium percarbonate, sodium perborate, sodium persulfate, butyl peroxide, and benzyl peroxide. Other redox oxidizing agents include cobalt (III) complexes including cobalt hexamine complexes, and periodates. Mixtures of one or several types of redox oxidizing agents can be used if desired.

Still another essential component of the color developing composition of this invention is that primary "stabilizing" compound that is a cyclicaminomethanediphosphonic acid (and salts thereof), or mixtures thereof, as described in U.S. Pat. No. 4,873,180 (noted above). "Cyclicamino" groups comprise 3- to 6-membered rings, including but not limited to substituted or unsubstituted aziridino, pyrrolidino, imidazolidino, piperidino, piperazino, isoindolino, and morpholino groups. The substituted or unsubstituted morpholino groups are preferred. Suitable substituents for the cyclicamino groups include, but are not limited to, alkyl groups having 1 to 4 carbon atoms, halo groups, nitro groups, cyano groups, aryl groups, alkoxy groups having 1 to 4 carbon atoms, aryloxy groups, sulfamoyl groups, acyloxy groups, acylamino groups, ureido groups, sulfonamido groups, hydroxy groups, and others that would be readily apparent to one skilled in the art from the teaching of U.S. Pat. No. 4,873,180, incorporated herein by reference.

The "cyclicamino" groups are attached to a methyl group that includes two phosphonic acids (or alkali metal or ammonium salts thereof) and the remaining valence of the methyl group can be hydrogen, a substituted or unsubstituted alkyl group, or a substituted or unsubstituted aryl group.

Representative cyclicaminomethanediphosphonic acids (or salts thereof) are compounds 7–17 of U.S. Pat. No. 4,873,180 (noted above). A most preferred compound of this type is morpholinomethanediphosphonic acid or a salt thereof that is commercially available as BUDEX™ 5103 from Budenheim (Germany).

Buffering agents are generally present in the amplified color developing compositions of this invention to provide or maintain desired alkaline pH of from about 8 to about 13, and preferably from about 10 to about 12. Useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example, sodium hydroxide or potassium hydroxide).

Another optional component of the amplified color developing composition of this invention is a metal ion sequestering agent other than the cyclicaminomethanediphosphonic acids noted above. Such compounds include, but are not limited to aminopolycarboxylic acids (and salts thereof) and aminopolyphosphonic acids (and salts thereof) that have at least two (and preferably five) phosphonic acid (or salt) groups. A mixture of such compounds can be used if desired. Suitable salts include ammonium and alkali metal ions salts. Useful amounts of such metal ion sequestering agents are well known in the art and are generally at least 0.0025 mol/l.

Aminopolycarboxylic acids include the various compounds commonly used as ligands in photographic bleaching agents for example as described in U.S. Pat. No. 4,546,068 (Kuse), U.S. Pat. No. 4,596,765 (Kurematsu et al.), U.S. Pat. No. 4,892,804 (noted above), U.S. Pat. No. 4,975,357 (Buongiorne et al.), U.S. Pat. No. 5,034,308 (Abe et al.), and *Research Disclosure* publications Item 20405 (April, 1981), Item 18837 (December, 1979), Item 18826 (December, 1979), and Item 13410 (December, 1975).

Examples of such compounds include, but are not limited to, ethylenediaminetetraacetic acid (EDTA), 1,3-propylenediaminetetraacetic acid (PDTA), diethylenetriaminepentaacetic acid (DTPA), cyclohexanediaminetetraacetic acid (CDTA), hydroxyethylethylenediaminetriacetic acid (HEDTA), ethylenediaminedisuccinic acid (EDDS) as described in U.S. Pat. No. 5,679,501 (Seki et al.) and EP 0 532 001B1 (Kuse et al.). Other useful disuccinic acids are described in U.S. Pat. No. 5,691,120 (Wilson et al.). Aminomonosuccinic acids (or salts thereof) have at least one nitrogen atom to which a succinic acid (or salt) group is attached, polyamino monosuccinic acids, ethylenediamine monosuccinic acid (EDMS).

Other classes of aminopolycarboxylic acids or polyaminopolycarboxylic acids include iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl, and t-butyl) as described in EP 0 532 003A1 (Kuse et al.). Particularly useful alkyliminodiacetic acids are methyliminodiacetic acid (MIDA) and ethyliminodiacetic acid (EIDA).

Still other useful aminopolycarboxylic acids can be represented by the following Structure I:

I

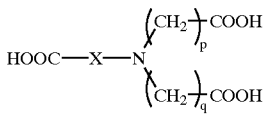

wherein p and q are independently 1, 2 and 3, and preferably each is 1. The linking group X can be H, with no carboxy group attached, or it may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

Still other useful aminocarboxylic acids include but are not limited to, β-alaninediacetic acid (ADA), nitrilotriacetic acid (NTA), glycinesuccinic acid (GSA), 2-pyridylmethyliminodiacetic acid (PMIDA), citric acid, tartaric acid, 1,3-diamino-2-propanetetraacetic acid (DPTA), diethylenetriaminepentaacetic acid (DTPA), and iminodisuccinic acid, and salts thereof.

Particularly useful additional aminopolyphosphonic acids include compounds represented by the following Structure II:

II

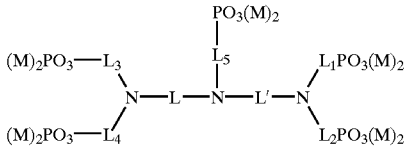

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain.

Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

A particularly useful compound of this type is diethylenetriaminepentamethylenephosphonic acid or an alkali metal salt thereof (available as DEQUEST™ 2066 from Solutia Co.).

The amplified color developing compositions of this invention can also include one or more of a variety of other addenda that are commonly used in photographic processing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art (see for example, *Research Disclosure* publication 38957 noted above). The amounts of such optional additives are well known in the art also.

The following TABLE I lists the general and preferred amounts of the essential and some optional components of the amplified color developing compositions of this invention. The preferred ranges are listed in parentheses ( ), and all of the ranges are considered to be approximate or "about" in the upper and lower end points. During processing, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I

| COMPONENT | CONCENTRATIONS |
|---|---|
| Color developing agent(s) | 0.001–1 mol/l (0.005–0.8 mol/l) |
| Antioxidant(s) | 0.001–1 mol/l (0.005–0.08 mol/l) |
| Buffering agent(s) | 0.01–3 mol/l (0.05–2 mol/l) |
| Cyclicaminomethane-diphosphonic acid | 0.0005–0.5 mol/l (0.001–0.35 mol/l) |
| Redox oxidizing agent | 0.005–5 mol/l (0.01–2.5 mol/l) |
| Optional aminopolycarboxylic acid or aminopolyphosphonic acid sequestering agent | 0–0.3 mol/l (0.0025–0.25 mol/l) |

The amplified color developing compositions of this invention have utility to provide color dye image in imagewise exposed color photographic silver halide elements comprising a support and one or more silver halide emulsion layers containing an imagewise distribution of developable silver halide emulsion grains and dye providing chemistry. A wide variety of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well.

The present invention is particularly useful to process high chloride (greater than 70 mole % chloride and preferably greater than 90 mole % chloride, based on total silver) emulsions in photographic color papers. Such materials can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK DURATRANS, KODAK DURACLEAR, KODAK EKTAMAX RAL and KODAK DURAFLEX photographic materials and KODAK Digital Paper Type 2976 can also be processed using the present invention. The compositions and constructions of such commercial color photographic elements can be readily determined by one skilled in the art.

Processed of an imagewise exposed photographic silver halide element is generally carried out by contacting the element with the amplified color developing composition of this invention under suitable time and temperature conditions, in suitable processing equipment, to produce the desired developed color dye image. Additional processing steps can then be carried out using conventional procedures, including but not limited to, one or more bleaching, fixing, bleach/fixing, washing (or rinsing), stabilizing and drying steps, in any particular desired order as would be known in the art. An intermediate "stop" bath can be used between the amplified color development step and a bleaching step. Useful processing steps, conditions and materials useful therefor are well known for the various processing protocols as described for example in U.S. Pat. No. 5,723,268 (noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). Preferably, the present invention can be used to process color photographic papers having pigmented resin-coated paper supports.

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al) and publications noted therein.

Amplified color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in Research Disclosure publication 38957 noted above, U.S. Pat. No. 5,582,958 (Buchanan et al.) and U.S. Pat. No. 5,753,423 (Buongiorne et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP 0 532,003A1, and ethylenediamine monosuccinic acid and similar compounds as described in U.S. Pat. No. 5,691,120 (Wilson et al.). Useful fixing agents are also well known in the art and include various thiosulfates and thiocyanates or mixtures thereof.

The processing time and temperature used for each processing step of the present invention are generally those conventionally used in the art. For example, redox amplification is generally carried out at a temperature of from about 20 to about 50° C. The overall processing time can be up to 4 minutes, and preferably from about 90 to about 180 seconds. Shorter overall color development times, for example from about 15 to about 30 seconds, are desired for processing color photographic papers in the practice of this invention.

The amplified color developing composition of this invention can be used as a working strength solution or replenisher.

Generally, the amplified composition of this invention is formulated by mixing two or three "parts" of individual solutions that are manufactured, transported, and stored separately or as amplified color developing "kits" prior to use. Thus, an amplified color developing kit of this invention can include a first "part" or solution that includes all of the essential components (color developing agent, hydroxylamine antioxidant, and cyclicaminomethanediphosphonic acid) except the redox oxidizing agent (such as a peroxide) that is included in a second "part" or solution.

Alternatively, the amplified color developing kit of this invention includes three parts that have, as a minimum, the following components:

Part A: Color developing agent,

Part B: Cyclicaminomethanediphosphonic acid (or salt thereof), and

Part C: Redox oxidizing agent.

A hydroxylamine antioxidant can be included in either Part A or Part B in the three-part kit. Various optional components can be included in any or all of these parts. The amounts of the essential and optional components in the various parts would be readily known in the art.

The color images obtained using the present invention can be further processed electronically through conventional digital means, transmitted, modified, or stored in digital or physical form.

The following examples are provided to illustrate the practice of this invention and not to limit it in any way. Unless otherwise indicated, percentages are by weight.

Example 1

Preparation, Evaluation and Comparisons of Redox Amplification Compositions

In this study, we compared the stability of five amplified developing compositions A–E as shown in TABLE II below at room temperature in opened glass containers. A decrease in volume due to evaporation was compensated for by periodically adding deionized water to the compositions. The compositions were analyzed periodically for the amount of remaining color developing agent, hydroxylamine sulfate antioxidant, and peroxide and changes in pH. The results of these measurements are shown in TABLES II–V below.

TABLE II

| | Level (g/l) | | | | |
|---|---|---|---|---|---|
| Component | A | B | C | D | E |
| Aminotri(methylenephosphonic acid) pentasodium salt (40%) | 5 | | 6.75 | | |
| DTPA: Diethylenetetraamine pentaacetic acid, sodium salt | 0.93 | 3.32 | | | |

TABLE II-continued

| Component | Level (g/l) A | B | C | D | E |
|---|---|---|---|---|---|
| Morpholinomethanediphosphonic acid, disodium salt (50%) (BUDEX ™ 5103) | | | | 2.44 | 4.03 |
| Potassium phosphate dibasic | 30.53 | 30.53 | 30.53 | 30.53 | 30.53 |
| Potassium hydroxide (45%) | 22.22 | 22.22 | 22.22 | 22.22 | 22.22 |
| Potassium chloride | 0.4 | 0.4 | 0.4 | 0.4 | 0.4 |
| Potassium bromide | 0.0015 | 0.0015 | 0.0015 | 0.0015 | 0.0015 |
| Hydroxylamine sulfate | 1.2 | 1.2 | 1.2 | 1.2 | 1.2 |
| KODAK Color Developing Agent CD-3 | 5.5 | 5.5 | 5.5 | 5.5 | 5.5 |
| TWEEN 80 emulsifier (ICI Surfactants) | 0.3 | 0.3 | 0.3 | 0.3 | 0.3 |
| PH 11.5 | | | | | |
| 30% Hydrogen peroxide | 3 ml | 3 ml | 3 ml | 3 ml | 3 ml |

TABLE III

| Time (hours) | Kodak Color Developing Agent CD-3 Remaining (%) A | B | C | D | E |
|---|---|---|---|---|---|
| 0 | 100 | 100 | 100 | 100 | 100 |
| 24 | 78.57 | 77.40 | 95.48 | 97.67 | 98.37 |
| 48 | 59.71 | 61.66 | 89.87 | 93.56 | 95.64 |
| 72 | 54.21 | 56.42 | 84.63 | 90.34 | 93.28 |

TABLE IV

| Time (hours) | Hydroxylamine sulfate Remaining (%) A | B | C | D | E |
|---|---|---|---|---|---|
| 0 | 100 | 100 | 100 | 100 | 100 |
| 24 | 0 | 0 | 35.71 | 68.07 | 77.24 |
| 48 | "NA" | "NA" | 0 | 41.18 | 49.59 |

NA = not available

TABLE V

| Time (hours) | Hydrogen Peroxide Remaining (%) A | B | C | D | E |
|---|---|---|---|---|---|
| 0 | 100 | 100 | 100 | 100 | 100 |
| 24 | 32.35 | 18.75 | 74.29 | 85.29 | 78.13 |
| 48 | 8.82 | 0 | 57.14 | 76.47 | 71.88 |
| 72 | 0 | "NA" | 45.71 | 64.71 | 65.63 |

This study showed that Composition A containing DPTA was less stable than the conventional Composition A. Compositions C, D, and E were more stable than the conventional Composition A. However, the compositions of this invention (D and E) containing a cyclicaminomethanediphosphonic acid, even at half the molar concentration of the two conventional agents used in Composition A, was more stable than Compositions A and B. Only a small decrease in pH was observed with all the solutions.

Example 2

Use of Two Stabilizing Compounds

In this study, we evaluated the use of combination of compounds to stabilize amplified color developing compositions. The compositions, described in TABLE VI below, were evaluated as described in Example 1. The results of these measurements are shown in the following TABLES VII–IX.

TABLE VI

| Component | Level (g/l) A | F | G | H |
|---|---|---|---|---|
| Aminotri(methylenephosphon-ic acid) pentasodium salt (40%) | 5 | 4.08 | | 2.04 |
| DTPA: Diethylenetetraamine pentaacetic acid, sodium salt | 0.93 | | | |
| Morpholinomethanediphosphonic acid, disodium salt (50%) (BUDEX ™ 5103) | | | 2.44 | 1.22 |
| Potassium phosphate dibasic | 30.53 | 30.53 | 30.53 | 30.53 |
| Potassium hydroxide (45%) | 22.22 | 22.22 | 22.22 | 22.22 |
| Potassium chloride | 0.4 | 0.4 | 0.4 | 0.4 |
| Potassium bromide | 0.0015 | 0.0015 | 0.0015 | 0.0015 |
| Hydroxylamine sulfate | 1.2 | 1.2 | 1.2 | 1.2 |
| KODAK Color Developing Agent CD-3 | 5.5 | 5.5 | 5.5 | 5.5 |
| TWEEN 80 emulsifier (ICI Surfactants) | 0.3 | 0.3 | 0.3 | 0.3 |
| PH 11.5 | | | | |
| 30% Hydrogen peroxide | 3 ml | 3 ml | 3 ml | 3 ml |

TABLE VII

| Time (hours) | KODAK Color Developing Agent CD3 Remaining (%) A | F | G | H |
|---|---|---|---|---|
| 0 | 100 | 100 | 100 | 100 |
| 24 | 85.82 | 98.91 | 98.72 | 99.64 |
| 48 | 62.36 | 96.91 | 97.63 | 98.73 |
| 72 | 58.18 | 94.19 | 95.26 | 96.37 |

TABLE VIII

| Time (hours) | Hydroxylamine sulfate Remaining (%) A | F | G | H |
|---|---|---|---|---|
| 0 | 100 | 100 | 100 | 100 |
| 24 | 0 | 86.90 | 94.74 | 92.52 |
| 48 | 0 | 53.57 | 71.58 | 86.92 |
| 72 | "NA" | 34.52 | 56.84 | 68.22 |

TABLE IX

| Time (hours) | Hydrogen peroxide Remaining (%) A | F | G | H |
|---|---|---|---|---|
| 0 | 100 | 100 | 100 | 100 |
| 24 | 54.29 | 88.24 | 93.75 | 93.94 |
| 72 | 8.57 | 70.59 | 81.25 | 90.91 |
| 96 | "NA" | 64.71 | 78.13 | 87.88 |

These results show that an amplified color developing composition of this invention (I) can be prepared using a mixture of stabilizing compounds to provide synergistically improved stability.

Example 3

Three-Part Amplified Color Developing Kit

A three-part amplified color developing kit of the present invention was prepared with three following solutions (Parts A, B, and C):

| PART | COMPONENT | CONCENTRATION (g/l) |
|---|---|---|
| A | Kodak Color Developing Agent CD-3 | 11.11 |
| (pH 1.65) | Hydroxylamine sulfate (HAS) | 2.4 |
| B | Morpholinomethanediphosphonic acid, disodium salt (50%) (BUDEX ™ 5103) | 4.03 |
| (pH 12.11) | Potassium phosphate dibasic | 61.06 |
| | Potassium hydroxide (45%) | 44.44 |
| | Potassium chloride | 0.8 |
| | Potassium bromide | 0.0030 |
| | TWEEN 80 emulsifier | 0.6 |
| C | Hydrogen Peroxide (30%) | 3 ml |

Approximately 499 ml of Part A and 499 ml of Part B were combined with 3 ml of Part C to make 1 liter of a working strength amplified color developing composition of this invention. The final composition pH was 11.6.

Example 4

Color Paper Processing

Samples of conventional KODAK Edge 8 Color Paper were given a step wedge test object exposure at 1/10 sec with HA-50, NP-11 filters, and 0.3 Inconel on a conventional 1B sensitometer. The samples were then processed using an amplified color developing composition of this invention provided by combining the three solutions of the kit as described in Example 3. Processing was carried out in a deep tank processor using conventional EKTACOLOR Process RA-4 conditions and steps as follows:

| | | |
|---|---|---|
| Color Development | 38° C. | 15 seconds |
| Bleach/fixing | 35° C. | 45 seconds |
| Washing/Stabilizing | 35° C. | 90 seconds |

Bleach/fixing was carried out using commercially available KODAK EKTACOLOR Prime Bleach-Fix and the washing step was carried out using KODAK EKTACOLOR Prime Stabilizer. After processing, the color paper samples were allowed to dry in the air at ambient temperature. The desired colored images were obtained in all of the samples.

Example 5

Alternative Three-Part Amplified Color Developing Kit

Another three-part amplified color developing kit of this invention was prepared by modifying the three-part kit described in Example 3. The hydroxylamine sulfate antioxidant was taken out of Part A and included in Part B, and a small amount of metabisulfite ions (0.02–0.1 mol/l) was added to stabilize the KODAK Color Developing Agent CD-3 in Part A. The three parts were concentrated as high as 10 time the working strength and diluted appropriately for use. This color developing kit was also used to provide color images in color paper samples as described in Example 4 above.

Example 6

Amplified Color Developing Composition with Two Stabilizing Compounds

In this study, we evaluated the use of morpholinomethanediphosphonic acid alone and in combination with known metal ion sequestering agents in amplified color developing compositions. The compositions had the components shown in TABLE X below and were evaluated as described in Example 1. The results of these measurements are shown in the following TABLES XI and XII.

TABLE X

| Component | Level (g/l) A | J | K | L |
|---|---|---|---|---|
| Aminotri(methylenephosphonic acid) pentasodium salt (40%) | 5 | | | |
| DTPA: Diethylenetetraamine pentaacetic acid, sodium salt | 0.93 | | | |
| Morpholinomethanediphosphonic acid, disodium salt (50%)(BUDEX ™ 5103) | | 0.61 | 0.61 | 1.22 |
| Diethylenetriaminepentaphosphonic acid, sodium salt (40%) (DEQUEST ® 2066) | | | 5.82 | 2.91 |
| Potassium phosphate dibasic | 30.53 | 30.53 | 30.53 | 30.53 |
| Potassium Hydroxide (45%) | 22.22 | 22.22 | 22.22 | 22.22 |
| Potassium chloride | 0.4 | 0.4 | 0.4 | 0.4 |
| Potassium bromide | 0.0015 | 0.0015 | 0.0015 | 0.0015 |
| Hydroxylamine sulfate | 1.2 | 1.2 | 1.2 | 1.2 |
| KODAK Color Developing Agent CD-3 | 5.5 | 5.5 | 5.5 | 5.5 |
| TWEEN 80 emulsifier | 0.3 | 0.3 | 0.3 | 0.3 |
| pH 11.5 | | | | |
| Hydrogen peroxide (30%) | 3 ml | 3 ml | 3 ml | 3 ml |

TABLE XI

| Time (hours) | KODAK Color Developing Agent CD3 Remaining (%) A | J | K | L |
|---|---|---|---|---|
| 0 | 100 | 100 | 100 | 100 |
| 24 | 94.5 | 98.9 | 99.8 | 100 |
| 48 | 85.8 | 96.9 | 98.9 | 99.1 |
| 72 | 70.1 | 94.3 | 98.4 | 98.7 |

TABLE XII

| | Hydrogen Peroxide Remaining (%) | | | |
|---|---|---|---|---|
| Time (hours) | A | J | K | L |
| 0 | 100 | 100 | 100 | 100 |
| 24 | 71 | 90.3 | 85.7 | 92.9 |
| 48 | 42 | 83.9 | 82.1 | 89.3 |
| 72 | 19.3 | 77.4 | 85.7 | 92.8 |

These results show that the use of morpholinomethanediphosphonic acid alone or in combination with a conventional metal ions sequestering agent can improve the stability of the amplified color developing compositions of this invention.

The invention has been described in detail with particular reference to preferred embodiments thereof, but it will be understood that variations and modifications can be effected within the spirit and scope of the invention.

We claim:

1. A stabilized photographic amplified color developing composition that comprises:

a) at least 0.001 mol/l of a color developing agent, b) at least 0.005 mol/l of a redox oxidizing agent, c) at least 0.001 mol/l of a hydroxylamine antioxidant, and d) at least 0.0005 mol/l of a cyclicaminomethanediphosphonic acid or a salt thereof.

2. The composition of claim 1 having a pH of from about 10 to about 12.

3. The composition of claim 1 wherein said color developing agent is present in an amount of from about 0.001 to about 1 mol/l, said redox oxidizing agent is present in an amount of from about 0.005 to about 5 mol/l, and said hydroxylamine antioxidant is present in an amount of from about 0.001 to about 1 mol/l.

4. The composition of claim 1 wherein said color developing agent is present in an amount of from about 0.005 to about 0.8 mol/l, said redox oxidizing agent is present in an amount of from about 0.01 to about 2.5 mol/l, and said hydroxylamine antioxidant is present in an amount of from about 0.005 to about 0.8 mol/l.

5. The composition of claim 1 wherein said antioxidant is hydroxylamine sulfate.

6. The composition of claim 1 wherein said redox oxidizing agent is hydrogen peroxide or a compound that provides hydrogen peroxide.

7. The composition of claim 6 wherein said redox oxidizing agent is present in an amount of from about 0.01 to about 2.5 mol/l.

8. The redox amplification composition of claim 1 wherein said cyclicaminomethanediphosphonic acid or salt thereof is present in an amount of from about 0.0005 to about 0.5 mol/l.

9. The redox amplification composition of claim 1 wherein said cyclicaminomethanediphosphonic acid or salt thereof is present in an amount of from about 0.001 to about 0.35 mol/l.

10. The composition of claim 1 further comprising a polyaminopolyphosphonic acid or a salt thereof that is represented by the following Structure II:

II

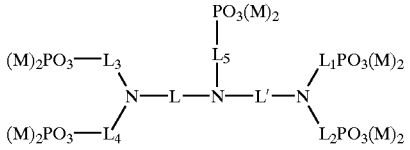

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation.

11. The composition of claim 1 wherein said color developing agent is N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), or 4-(N-ethyl-N-2-methanesulfonylaminoethyl)-2-methylphenylenediamine sesquisulfate.

12. The composition of claim 1 further comprising a polyaminopolycarboxylic acid or salt thereof.

13. An aqueous redox amplification composition having a pH of from about 10 to about 12 and comprising:

a) from about 0.001 to about 1 mol/l of a color developing agent that is 4-(N-ethyl-N-β-hydroxyethylamino)-2-methylaniline sulfate (KODAK Color Developing Agent CD-4) or 4-(N-ethyl-N-2-methanesulfonylaminoethyl)-2-methylphenylenediamine sesquisulfate (KODAK Color Developing Agent CD-3), b) from about 0.001 to about 1 mol/l of hydroxylamine sulfate as an antioxidant for said color developing agent, c) from about 0.005 to about 5 mol/l of hydrogen peroxide or a compound that provides hydrogen peroxide, and d) from about 0.0005 to about 0.5 mol/l of morpholinomethanediphosphonic acid or a salt thereof.

14. A method for providing a color image comprising contacting an imagewise exposed color photographic element with a stabilized amplified color developing composition that comprises:

a) at least 0.001 mol/l of a color developing agent, b) at least 0.005 mol/l of a redox oxidizing agent, c) at least 0.001 mol/l of a hydroxylamine antioxidant, and d) at least 0.0005 mol/l of a cyclicaminomethanediphosphonic acid or a salt thereof.

15. The method of claim 14 wherein said color photographic element is a photographic color paper.

16. A method for providing a color image comprising contacting an imagewise exposed color photographic element with a stabilized photographic redox amplification composition that has a pH of from about 10 to about 12 and comprises:

a) from about 0.001 to about 1 mol/l of a color developing agent that is 4-(N-ethyl-N-β-hydroxyethylamino)-2-methylaniline sulfate (KODAK Color Developing Agent CD-4) or 4-(N-ethyl-N-2-methanesulfonylaminoethyl)-2-methylphenylenediamine sesquisulfate (KODAK Color Developing Agent CD-3), b) from about 0.001 to about 1 mol/l of hydroxylamine sulfate as an antioxidant for said color developing agent, c) from about 0.005 to about 5 mol/l of hydrogen peroxide or a compound that provides hydrogen peroxide, and d) from about 0.0005 to about 0.5 mol/l of morpholinomethanediphosphonic acid or a salt thereof.

17. The method of claim 16 wherein said color photographic element is a color photographic paper.

18. A method of photographic processing comprising the steps of:

A) contacting an imagewise exposed color photographic silver halide element with a stabilized amplified color developing composition that comprises:

a) at least 0.001 mol/l of a color developing agent, b) at least 0.005 mol/l of a redox oxidizing agent, c) at least 0.001 mol/l of a hydroxylamine antioxidant, and d) at least 0.0005 mol/l of a cyclicaminomethanediphosphonic acid or a salt thereof, and B) desilvering said color developed color photographic silver halide element.

19. A photographic processing kit comprising:

A) a first solution comprising a color developing agent, a cyclicaminomethanediphosphonic acid or salt thereof, and a hydroxylamine antioxidant, and B) a second solution that comprises a redox oxidizing agent.

20. A photographic processing kit comprising:

A) a first solution that comprises a color developing agent,

B) a second solution that comprises a cyclicaminomethanediphosphonic acid or salt thereof, and C) a third solution that comprises a redox oxidizing agent, said first or second solution, or both, further comprising a hydroxylamine antioxidant.

* * * * *